US005997726A

United States Patent [19]

Fersing et al.

[11] Patent Number: 5,997,726

[45] Date of Patent: Dec. 7, 1999

[54] METHOD FOR FLUID CATALYTIC CRACKING OF HYDROCARBON FEEDSTOCK

[75] Inventors: Marc Fersing, Alma, Mich.; Mariano Del Pozo, Le Havre; Thierry Gauthier, Brignais, both of France

[73] Assignee: Total Raffinage Distribution S.A., Puteaux, France

[21] Appl. No.: 09/068,500

[22] PCT Filed: Sep. 16, 1997

[86] PCT No.: PCT/FR97/01627

§ 371 Date: May 12, 1998

§ 102(e) Date: May 12, 1998

[87] PCT Pub. No.: WO98/12279

PCT Pub. Date: Mar. 26, 1998

[30] Foreign Application Priority Data

Sep. 18, 1996 [FR] France ..... 96 11369

[51] Int. Cl.[6] ..... C10G 11/00

[52] U.S. Cl. ..... 208/113; 208/120.01; 208/125; 208/126; 208/127; 585/653; 422/139; 422/140; 422/141; 422/144; 422/142; 422/145; 422/147

[58] Field of Search ..... 208/113, 120.1, 208/126, 125, 127; 585/653; 422/139, 140, 141, 142, 144, 145, 147

[56] References Cited

U.S. PATENT DOCUMENTS 5,660,716 8/1997 Bourgogne et al. ..... 208/163

FOREIGN PATENT DOCUMENTS 663 434 7/1975 European Pat. Off. .
209 442 1/1987 European Pat. Off. .
315 179 5/1989 European Pat. Off. .
344 032 11/1989 European Pat. Off. .
479 645 4/1992 European Pat. Off. .

*Primary Examiner*—Walter D. Griffin
*Assistant Examiner*—Nadine Preisch
*Attorney, Agent, or Firm*—Sughrue, Mion, Zinn, Macpeak & Seas, PLLC

[57] ABSTRACT

A hydrocarbon catalytic cracking process in which, a substantial portion of the hydrocarbons is pulverized and placed in contact with a specific contact zone, which is composed of: a mixing chamber having a maximum section $S_2$, the upper part of which is fed with a heated regenerated catalyst through an upper opening delimiting a catalyst-flow section $S_1$, and a descending-flow reaction area, in which the solid-gas mixture emanating from the mixing chamber is poured through an intermediate opening having a section $S_3$ located in the lower part of said chamber. The ratios $S_2/S_1$ and $S_2/S_3$ have values of between 1.5 and 8.

15 Claims, 2 Drawing Sheets

METHOD FOR FLUID CATALYTIC CRACKING OF HYDROCARBON FEEDSTOCK

BACKGROUND OF THE INVENTION

The present invention concerns a process and device for catalytic cracking of a hydrocarbon charge in a descending bed, utilizing an improved contact zone between the charge and the catalyst.

It is known that, in the petroleum industry, "Fluid Catalytic Cracking", or "FCC," has come to occupy an increasingly important place in refining, since it allows the composition of crude oils to be adjusted to respond to the demand of the refined products market.

In these processes, the charge is cracked in the gas phase in the absence of hydrogen. The reaction temperature is about 500° C. and pressure generally approaches atmospheric pressure. During the cracking reaction, the catalyst becomes covered with coke and traces of heavy hydrocarbons, and the heat generated from the combustion of this coke during the regeneration operation in the presence of air or oxygen makes it possible to heat the catalyst to the desired temperature in order to supply the necessary calories to the cracking reaction after the catalyst has been reinjected into the reactor.

These FCC processes are habitually carried out in ascending flux reactors, thus giving the English-derived term of "riser reactor." However, this method of operation poses a number of problems: the catalyst particles in the fluidized bed exist in an unstable equilibrium, since they tend, first, to rise because of the ascent of the gases which ensure fluidized bed sintering and vaporization of the charge, and second, to fall because of the weight thereof.

As a result, the C/O ratio between the catalyst flow rate C and the flow rate O of the charge to be processed is limited to a maximum value normally of between 3 and 7 in current reactors, and usually of about 5.

Furthermore, in ascending flux reactors particles accumulate near the reactor walls, thus producing an excess cracking of the hydrocarbons in these locations, a phenomenon which forms coke, hydrogen, methane, and ethane instead of the products having the desired high octane number, while, in the center of the reactor, where fewer particles are found, insufficient conversion of the charge occurs.

Finally, while, overall, the catalyst grains rise in the reactor, some of them may fall back in certain places in proximity to the wall, because of the accumulation phenomenon explained above. This occurrence, known in English as "back-mixing," also leads to a localized reduction of conversion, since the grains which fall back are partially deactivated and produce less effect on the charge than the grains which rise. This phenomenon is especially troublesome because the aforementioned C/O ratio drops.

In order to remedy the problems posed by the riser, it was long ago suggested that reactors exhibiting downward catalyst flow, or "downers" be used (see, in this regard, U.S. Pat. No. 2,420,558).

In fact, it is known that the basic difference between these two types of reactors lies in the fact that the relative positions of the catalyst and of the charge remain substantially the same along the entirety of the downer, since the vapor and solid phases are placed in motion by the effect of gravity.

Accordingly, there is an absence of back-mixing, the radial homogeneity of the catalyst in the reactor is preserved, and the flow in this reactor is of the piston type. This makes it possible to impart good selectivity to the cracking reaction.

Furthermore, reaction times can apparently be reduced substantially as compared with the riser and may be substantially shorter than 1 second, and it appears possible to increase freely the flow rate of the catalyst with no adverse effect on particle movement, as is the case in a riser.

However, the use of a downer poses many difficulties, with the result that no one has as yet truly risked conversion from an ascending to a descending flow on an industrial scale.

Indeed, while the downer is supposed to allow very short reaction times, it is technically very difficult to produce the mixture and achieve vaporization and separation of the hydrocarbons from the catalyst grains, when these operations must be carried out in a fraction of a second and with flow rates approaching 1,500 tons per hour of catalyst and 300 tons per hour of hydrocarbons at a high boiling point.

In particular, the downer exhibits a disadvantage linked to the initial mixture of catalyst and charge. In fact, the catalyst tends to fall immediately without producing back-flow or recirculation, thus causing an adverse effect on the initial transfer of mass and heat with the charge.

If the inlet flows of catalyst and charge were perfectly uniform, this effect would be insignificant. This is not the case, however, and, for this reason, in a cracking reactor the solids/gas mixture consists of an alternation of catalyst-rich and catalyst-poor areas.

In a downer, there is no mechanism allowing the charge to travel from one area to another. Accordingly, the fraction of hydrocarbons in contact with an area of low solids density will persist along the entire length of the reactor and will undergo inadequate thermal cracking caused by a premature deactivation of the catalyst. On the other hand, the hydrocarbons in a zone of high solids density may undergo excessive cracking.

To optimize simultaneously the charge/catalyst mixture and the quality of the cracking reactions themselves, U.S. Pat. No. 5,458,369 proposes a device in which the charge is pulverized, placed in contact with the catalyst, then partially cracked using an ascending flow. Next, the direction of flow is reversed and cracking is completed using a descending flow.

Nevertheless, this device is difficult to manufacture from a mechanical standpoint, and does not permit a very high-performing mixture in the case of high catalyst flow rates. In fact, when the direction of flow of the catalyst/charge mixture is reversed, the catalyst tends to become pelletized near the walls of the apparatus and is thus insulated from the vaporized charge.

SUMMARY OF THE INVENTION

Thus, the invention is intended to bring together the advantages of ascending flow, i.e., a satisfactory mixture of high charge and catalyst flow rates, and of descending flow, i.e., good selectivity of the cracking reactions themselves.

As part of these efforts, the Applicant has discovered that a special geometric configuration of the zone of contact between catalyst and charge makes it possible to optimize simultaneously the quality of the mixture and of the cracking reactions.

The present invention thus concerns a hydrocarbon catalytic cracking process, which includes a phase in which the hydrocarbons and catalyst particles are placed in contact with each other, a descending bed cracking reaction phase, a phase in which the deactivated catalyst and the effluent hydrocarbons are separated, at least one phase involving stripping of the deactivated catalyst, then a phase involving the regeneration of said catalyst under conditions in which the coke borne by the catalyst undergoes combustion, and finally, a phase in which the regenerated catalyst is recycled to the feed area, this process being characterized by the fact that a substantial portion of the hydrocarbons are pulverized and placed in contact with the catalyst in a specific contact area consisting of:

a mixing chamber having a maximum section $S_2$, in the upper part of which the heated, regenerated catalyst is fed through an upper opening which delimits a catalyst-flow section $S_1$, and a descending flow reaction area in which the solid/gas mixture emanating from the mixing chamber is poured though an intermediate opening having section $S_3$ located in the lower part of said chamber, and by the fact that the ratios $S_2/S_1$ and $S_2/S_3$ have values of between 1.5 and 8, and, preferably between 2.5 and 6.

The contact area in accordance with the invention allows the aforementioned objectives to be achieved. The geometry of this area proves especially applicable to short times, since it allows fast, complete vaporization of the charge.

This area permits homogeneous mixing inside the mixing chamber. A perfectly-agitated flow exists in this chamber, since the upper and intermediate small-section openings form necks which allow back-flow and recirculation of the catalyst inside the chamber. In this way, and although the flow is a descending one, the mixture is, overall, comparable to that produced in the mixing area of an ascending-flow reactor.

According to one feature of the invention, the ratio $S_1/S_3$ between the catalyst-flow section $S_1$ through the annular opening and the section $S_3$ of the intermediate opening is between 0.8 and 1.25 and, preferably, between 0.9 and 1.1, in order to allow optimal mixing inside the mixing chamber.

Advantageously, the hydrocarbons are injected in a reverse direction to the descending flow of the catalyst particles at an angle to the horizontal of between 2° and 45°, and preferably between 5 and 35°. In this way, mixing of the charge and catalyst is rendered optimal, since this direction of injection allows the charge to break up optimally the descending catalyst mass.

According to an additional feature of the invention, the reaction area flares beginning at the intermediate opening at an angle to the vertical of between 1 and 20°, and preferably between 2 and 15°, until reaching its maximum transverse section $S_4$.

This flare thus makes it possible to transform gradually the completely-agitated flow existing inside the mixing chamber into a piston-type flow in the reaction area. Given that a flow of this kind is especially advantageous for selectivity of the cracking reactions, the process according to the invention thus also unites the advantages inhering in conventional descending flow reactors.

Advantageously, the ratio $S_4/S_3$ between the maximum section $S_4$ of the reaction area and the section $S_3$ of the intermediate opening has a value of between 1.5 and 8, and preferably between 2.5 and 6.

According to a further feature of the invention, the ratio $S_2/S_4$ between the maximum section $S_2$ of the mixing chamber and the maximum section $S_4$ of the reaction area ranges between 0.8 and 1.25 and, preferably, between 0.9 and 1.1.

The invention also relates to an apparatus allowing implementing of the process described above.

To this end, the present invention relates to a hydrocarbon catalytic cracking apparatus comprising a descending-flow cracking reactor, means for the pressurized feed of this reactor with a hydrocarbon charge and particles of a regenerated cracking reactor, a device for separation of the products of the cracked charge and of the particles of deactivated catalyst, at least one system for stripping, using at least one fluid, of the particles of deactivated catalyst, at least one unit for regenerating said catalyst by means of combustion of the coke carried by the catalyst, and means for recycling the regenerated catalyst to the feed mechanism, this apparatus being characterized by the fact that it incorporates a specific area of contact between the hydrocarbons and the catalyst, this area consisting of:

a mixing chamber having a maximum section $S_2$, which is connected to means for feeding the regenerated catalyst through an upper opening delimiting a catalyst-flow section $S_1$, and a reaction area having a maximum section $S_4$ connected to the mixing chamber by an intermediate opening having a section $S_3$, and by the fact that the ratios $S_2/S_1$ and $S_2/S_3$ have values of between 1.5 and 8, and, preferably between 2.5 and 6.

BRIEF DESCRIPTION OF THE DRAWINGS

Other features and advantages of the invention will emerge from a reading of the following description of a specific embodiment provided with reference to the attached drawings, in which.

DETAILED DESCRIPTION OF THE PREFERRED EMBODIMENTS

Figure 1:
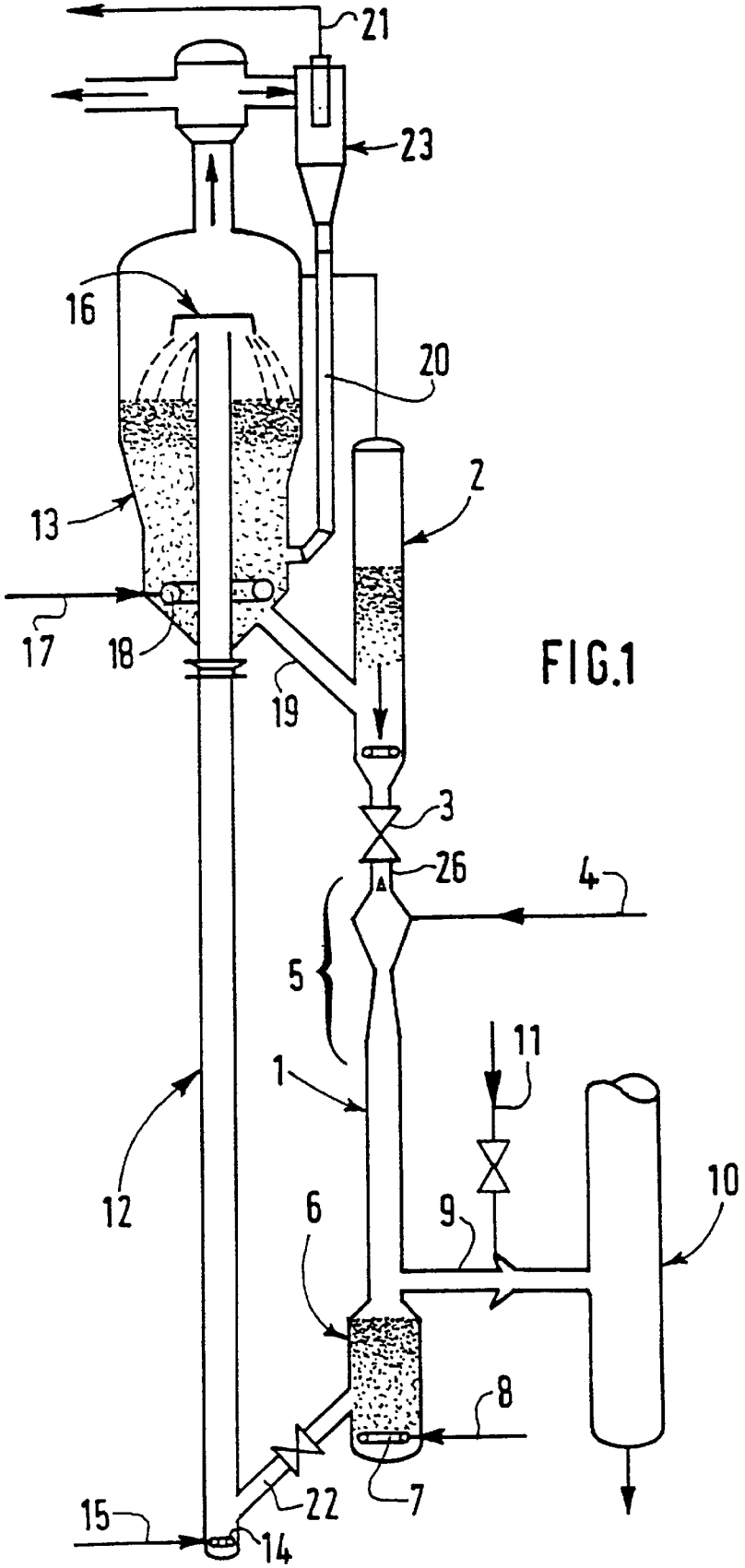
FIG. 1 is a diagrammatic view of a conversion unit according to the invention.

The apparatus illustrated comprises a tubular descending-flow reactor 1, or "downer," the upper part of which is fed with particles of a regenerated catalyst from a column 2 coaxial to this reactor. A valve 3 designed to adjust the ratio of the mass of catalyst to the mass of charge awaiting processing in the reactor is interposed between the reactor 1 and the column 2. A line 4 which feeds the reactor 1 with the conventionally preheated hydrocarbon charge to be processed empties below this valve. Injectors pulverize this charge into fine droplets at the top of the contact area 5, then the charge is mixed with the catalyst particles, the contact with which triggers the cracking reaction. The direction of injection of the charge, as well as the geometry of the contact zone, will be explained in detail below. The catalyst particles and the charge to be processed thus flow downward in the reactor 1.

At the reactor base, the spent catalyst particles flow into a stripping chamber 6, which is fitted at the base thereof with a diffuser 7 which is fed with water vapor through a line 8.

Also at the base of the reactor 1 and above the chamber 6 a line 9 empties, through which the cracking products and the hydrocarbons coming from the stripping means are circulated to a separating column 10. Before reaching this column 10, the gases carried away through the line 9 may be soaked with a hydrocarbon or with water vapor fed through a line 11 into the line 9.

The stripped catalyst particles are carried by gravity away from the chamber 6 through an inclined duct 22 to an ascending column 12, in which they are sent upward to a regenerator 13 by means of a supporting gas which is supplied through the line 15 and diffused at 14 at the base of the column 12.

The column 12 opens into the regenerator 13 below a ballistic separator 16, which separates the catalyst particles from the supporting gas. The catalyst particles are then conventionally regenerated in the regenerator by means of combustion of the coke that has been deposited on the surface thereof and of the remaining hydrocarbons, using a stream of air or oxygen that has been fed through the line 17 to the diffuser 18.

The regenerated catalyst particles are removed by gravity through the duct 19 and sent to the column 2 without thermal loss.

In the upper part of the regenerator 13, the combustion gases are carried away to cyclone traps 23 designed to separate out the fines, which are recycled through the duct 20 to the regenerator, and the gases, which are discharged through the line 21.

Figure 2:
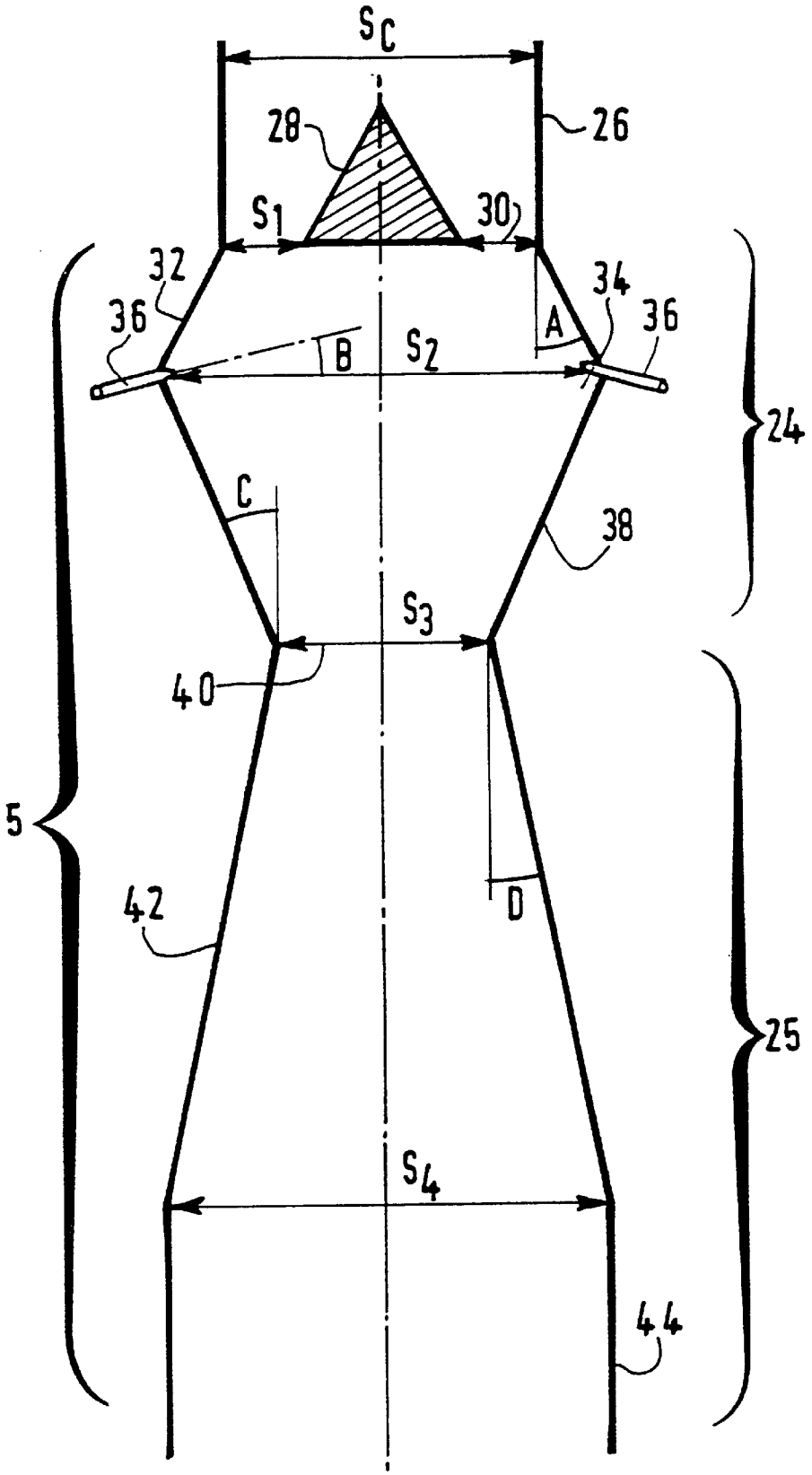
FIG. 2 is a more detailed view of the area of contact between the charge and the catalyst according to the invention.

FIG. 2 illustrates with enhanced precision the contact area or zone 5 object of the invention.

The contact zone 5 comprises a mixing chamber 24 and a reaction zone 25 arranged immediately below the latter.

The upper part of the mixing chamber is fed with heated regenerated catalyst through the cylindrical duct 26 having section $S_c$, which is connected to the column 2 described in FIG. 1 (but not shown in FIG. 2). A conventional blocking piece 28 is positioned at the lower end of the duct 26, thus delimiting an upper annular opening 30 in the mixing chamber 24, through which the catalyst flows in said chamber. This opening 30 thus delimits a catalyst-flow section $S_1$, which is smaller than the section $S_c$ of the duct 26.

The mixing chamber flares beginning at its upper opening 30 along a tapered portion 32 having a vertical angle A, until it reaches the maximum transverse section $S_2$. The angle A, which may, for example, be 40°, may be between 10 and 60°, while the section $S_2$, is, for example, equal to 5 $S_1$, but may be between 1.5 and 8 $S_1$.

The circumference 34 of the mixing chamber 24 at the area of maximum section thereof is equipped with a series of injectors 36 through which the charge is injected after the latter has been pulverized outside the apparatus.

The injectors 36 are positioned in such a way as to direct the charge droplets against the descending flow of the catalyst particles, at an angle B to the horizontal of, for example, 15°, but which may range between 2° and 45°. The number of injectors will be such that the descending catalyst in its entirety can be reached by the charge droplets.

The mixing chamber 24 then narrows beginning at its maximum section $S_2$ and extends through a tapered portion 28, until reaching its lower end having a transverse section $S_3$. The tapered portion 38 incorporates a vertical angle C, which may be 30°, but may range between 10 and 50°, while the section $S_3$ is, for example, equal to $S_2/4$, but may be between 2 $S_2/3$ and $S_2/8$.

This mixing chamber, which consists of two conical portions 32, 38 which widen and then narrow, is configured in such a way that a completely-agitated flow exists therein, allowing the back-flow and recirculation of the catalyst necessary for proper mixing of the latter with the vaporized charge.

A reaction zone 25 extends below the mixing 24 in the direction of the flow of the charge, this zone connecting with the mixing chamber through the lower end of the latter, which forms an intermediate opening 40 having section $S_3$.

The reaction zone 25 flares beginning at the intermediate opening and extending along a truncated portion 42 having a vertical angle D, until it reaches the maximum transverse section $S_4$ thereof. Angle D is, for example, 6°, but may range between 1 and 15°, while the section $S_4$ is, for example, 5 $S_3$, but may be between 1.5 and 8 $S_3$.

This flare allows the progressive modification of the nature of the flow of the charge/catalyst mixture. In fact, the flow agitated inside the mixing chamber is transformed in this way into a piston-type flow in the reaction zone, which is perfectly suited for providing good selectivity of the cracking reactions occurring therein.

Below this truncated portion 42 in the direction of flow of the charge, the reaction zone consists of a cylindrical extension 44 and has a substantially uniform section approaching the value of $S_4$, so as to maintain to the fullest possible extent the piston-type flow established at the time the charge enters the truncated section 42.

This description makes reference solely to the dimensional relationships existing between the different parts of the contact zone specified by the invention. The specialist will size the entirety of this zone based on the respective flow rates of the charge and the catalyst, and on the suitable retention time of the charge in the mixing chamber and in the reaction zone.

The catalyst-flow section $S_1$ of the upper opening 30 and the section $S_3$ of the intermediate opening 40 are, for example, 65 $cm^2$, but may be between 10 and 500 $cm^2$.

The maximum section $S_2$ of the mixing chamber 24 and the maximum section $S_4$ of the reaction zone 25 are, for example, 300 $cm^2$, but may be between 30 and 2,000 $cm^2$.

This description makes reference to a contact zone consisting of a series of surfaces of revolution, that is, cylindrical or truncated portions whose transverse sections are circular. However, the present invention also relates to any zone of contact in which there are certain relationships between the sections of the component elements thereof, whether they have a polygonal, ovoidal, or any other shape.

Furthermore, the contact zone according to the invention is used in any catalytic cracking apparatus in which the reactor functions utilizing descending charge flow, whatever the spent catalyst stripping and regeneration means used.

The following non-limiting example is intended to illustrate the implementation of the invention and the advantages thereof.

EXAMPLE

A petroleum charge had the following characteristics:
density at 15° C.: 0.925
50% distillation point: 470° C.
viscosity at 100° C.: $12.5\times10^{-6}$ $m^2/s$ (12.5 cst),
Conradson carbon residue: 1.7% by weight,
nickel content: 0.1 ppm by weight
nitrogen content: 390 ppm by weight
vanadium content: 1 ppm by weight.
This charge was fed into an ascending-flow catalytic cracker under the following working conditions:
catalyst: zeolite catalyst sold by Akzo,
catalyst/charge mass ratio: 5,
reaction temperature: 520° C.,
number of injectors: 8,
retention time in the reaction zone: 2 seconds.
This same charge was placed in a descending catalytic cracker equipped with a contact zone according to the invention, under the following working conditions:

catalyst: zeolite catalyst sold by Akzo,
catalyst/charge mass ratio: 8,
reaction temperature: 545° C.,
number of injectors: 8,
retention time in the reaction zone: 350 ms.

The yields obtained form these two cracking operations are recorded in the following comparative table:

| Yield in Weight-Percent | Conventional Cracker | Cracker according to the invention |
|---|---|---|
| Hydrogen, methane, and ethane | 3.2 | 2.3 |
| Paraffins at $C_3$ | 1.0 | 1.2 |
| Olefins at $C_3$ | 3.3 | 5.9 |
| Paraffins at $C_4$ | 1.9 | 2.6 |
| Olefins at $C_4$ | 4.7 | 7.8 |
| $C_5$ - (boiling point <160° C.) | 31.8 | 34.8 |
| Gasoline (boiling point 160–220° C.) | 11.7 | 11.5 |
| Light Cycle Oil (boiling point 220–360° C.) | 19.1 | 17.2 |
| Slurry (boiling point >360° C.) | 18.8 | 11.9 |
| Coke | 4.4 | 4.8 |

The example demonstrates that use of the catalytic cracking process according to the invention makes possible:

- a very sizable reduction of the production of dry gases (approximately −30%);
- an increased yield of liquefied petroleum gas (LPG) and total gasoline;
- an increase of conversion in general, since the percentage of the fraction that boils below 360° C. rises from 57.7% in the process according to prior art to 66.1% in the process according to the invention.

Furthermore, the quality of the gas produced is improved, since, as compared to prior art, an increase of the octane number is observed:

- by six points for the RON (Research Octane Number) of heavy gasoline (fraction boiling at between 160 and 220° C.)
- by 4 points for the MON (Motor Octane Number) of heavy gasoline
- by 2 points for the RON of light gasoline (fraction boiling at between 0 and 160° C.)
- by 1 point for the MON of light gasoline.

The process according to the invention thus makes it possible to increase cracking selectivity, by allowing a higher catalyst/charge mass ratio than in prior art (and, accordingly, a lower Δcoke; that is, a smaller difference between the quantities of coke on the catalyst at the inlet of the regeneration zone and at the outlet thereof).

The process according to the invention also makes it possible, when a given conversion is targeted, to process more difficult charges, in particular charges that are denser and in which the percentage of Conradson carbon residue is higher.

We claim:

1. Hydrocarbon catalytic cracking process, comprising a stage in which the hydrocarbons and particles of a catalyst are placed in contact, a descending bed cracking reaction stage, a stage in which a spent catalyst having been formed and effluent hydrocarbons are separated, at least one stage involving stripping of the spent catalyst, then a stage involving regeneration of said catalyst under conditions sufficient to combust coke carried on the catalyst, and, finally, a stage in which the regenerated catalyst is recycled in a feed zone, this process being characterized by the fact that at least a portion of the hydrocarbons is pulverized and placed in contact with the catalyst in a specific zone of contact, which is composed of:

- a mixing chamber having a maximum cross-section area $S_2$, in the upper part of which the heated, regenerated catalyst is fed through an upper opening which delimits a catalyst-flow cross-section area $S_1$,
- and a descending flow reaction area in which a solid/gas mixture emanating from the mixing chamber flows through an intermediate opening having cross-section area $S_3$, located in the lower part of said chamber,
- and by the fact that the ratios $S_2/S_1$ and $S_2/S_3$ have values of between 1.5 and 8.

2. Cracking process according to claim 1, wherein the ratio $S_1/S_3$ is between 0.8 and 1.25.

3. Cracking process according to claim 1, wherein the hydrocarbons are injected against the descending flow of the catalyst particles at an angle to the horizontal of between 2° and 45°.

4. Cracking process according to claim 1, wherein the reaction zone flares beginning at the intermediate opening at an angle to the vertical of between 1° and 20° until reaching a maximum transverse cross-section area $S_4$ thereof.

5. Cracking process according to claim 4, wherein the ratio $S_4/S_3$ has a value of between 1.5 and 8.

6. Cracking process according to claim 4, wherein the ratio $S_2/S_4$ is between 0.8 and 1.25.

7. Hydrocarbon catalytic cracking apparatus, comprising a descending-flow cracking reactor, means for the pressurized feed of the reactor with a hydrocarbon charge and particles of a regenerated cracking catalyst, a device for the separation of products of the cracked charge and particles of deactivated catalyst, at least one system for stripping, using at least one fluid, particles of deactivated catalyst, at least one unit for regenerating said catalyst by means for combustion of coke carried by the catalyst, and means for recycling the regenerated catalyst to the feed mechanism, the apparatus being characterized by the fact that it incorporates a specific area of contact between the hydrocarbons and the catalyst, said area comprising:

- a mixing chamber having a maximum cross-section area $S_2$, which is connected to means for feeding the regenerated catalyst through an upper opening delimiting a catalyst-flow cross-section area $S_1$,
- and a reaction area having a maximum cross-section area $S_4$ connected to the mixing chamber by an intermediate opening having a cross-section area $S_3$,
- and wherein the ratios $S_2/S_1$ and $S_2/S_3$ have values of between 1.5 and 8.

8. Apparatus according to claim 7, wherein the cross-section areas and $S_3$ measure between 10 and 500 $cm^2$.

9. Apparatus according to claim 7, wherein the cross-section areas $S_2$ and the maximum section $S_4$ are between 30 and 2,000 $cm^2$.

10. Cracking process according to claim 1, wherein said ratios are between 2.5 and 6.

11. Cracking process according to claim 2, wherein the ratio $S_1/S_3$ is between 0.9 and 1.1.

12. Cracking process according to claim 3, wherein said angle is between 5° and 35°.

13. Cracking process according to claim 4, wherein said angle is between 2° and 15°.

14. Cracking process according to claim 6, wherein the ratio $S_2/S_4$ is between 0.9 and 1.1.

15. Apparatus according to claim 7, wherein said ratios are between 2.5 and 6.

* * * * *